US006036786A

United States Patent [19]

Becker et al.

[11] Patent Number: 6,036,786

[45] Date of Patent: Mar. 14, 2000

[54] ELIMINATING STICTION WITH THE USE OF CRYOGENIC AEROSOL

[75] Inventors: David Scott Becker, Excelsior; Ronald J. Hanestad, Hammond; Gregory P. Thomes, Chaska; James F. Weygand, Carver; Larry D. Zimmerman, Apple Valley, all of Minn.

[73] Assignee: FSI International Inc., Chaska, Minn.

[21] Appl. No.: 08/873,270

[22] Filed: Jun. 11, 1997

[51] Int. Cl.[7] ..... B08B 3/02

[52] U.S. Cl. ..... 134/2; 134/7; 134/36; 134/902

[58] Field of Search ..... 134/2, 6, 7, 21, 134/36, 902; 451/38, 39, 75, 102

[56] References Cited

U.S. PATENT DOCUMENTS

| | | | |
|---|---|---|---|
| 2,699,403 | 1/1955 | Courts | 117/47 |
| 3,676,963 | 7/1972 | Rice et al. | 51/320 |
| 3,702,519 | 11/1972 | Rice et al. | 51/310 |
| 4,027,686 | 6/1977 | Shortes et al. | 134/33 |
| 4,038,786 | 8/1977 | Fong | 51/320 |
| 4,356,084 | 10/1982 | Hatton et al. | 209/211 |
| 4,389,820 | 6/1983 | Fong et al. | 51/410 |
| 4,489,740 | 12/1984 | Rattan et al. | 134/140 |
| 4,631,250 | 12/1986 | Hayashi | 430/329 |
| 4,655,847 | 4/1987 | Ichinoseki et al. | 134/7 |
| 4,744,181 | 5/1988 | Moore et al. | 51/436 |
| 4,747,421 | 5/1988 | Hayashi | 134/201 |
| 4,768,534 | 9/1988 | Anderson | 134/525 |
| 4,806,171 | 2/1989 | Whitlock et al. | 134/7 |
| 4,817,652 | 4/1989 | Liu et al. | 134/102 |
| 4,857,113 | 8/1989 | Hodge | 134/32 |
| 4,936,922 | 6/1990 | Cherry | 134/22.18 |
| 4,962,776 | 10/1990 | Liu et al. . | |
| 4,962,891 | 10/1990 | Layden | 239/597 |
| 4,972,677 | 11/1990 | Moriya et al. | 62/50 |
| 4,974,375 | 12/1990 | Tada et al. | 51/413 |
| 4,977,910 | 12/1990 | Miyahara et al. | 134/7 |
| 5,001,084 | 3/1991 | Kawai et al. | 437/231 |
| 5,009,240 | 4/1991 | Levi | 134/7 |
| 5,025,597 | 6/1991 | Tada et al. | 51/410 |
| 5,035,750 | 7/1991 | Tada et al. | 314/7 |
| 5,062,898 | 11/1991 | McDermott et al. | 134/7 |
| 5,094,696 | 3/1992 | Orsen | 134/38 |
| 5,108,512 | 4/1992 | Goffnet et al. | 134/7 |
| 5,125,979 | 6/1992 | Swain et al. | 134/7 |
| 5,129,956 | 7/1992 | Pickering et al. | 134/15 |
| 5,147,466 | 9/1992 | Ohmori et al. | 134/7 |
| 5,158,100 | 10/1992 | Tanaka et al. | 137/105 |
| 5,181,985 | 1/1993 | Lampert et al. | 156/635 |
| 5,195,548 | 3/1993 | Roger | 134/167 |
| 5,209,028 | 5/1993 | McDermott et al. | 51/426 |
| 5,217,925 | 6/1993 | Ogawa et al. | 437/225 |
| 5,258,097 | 11/1993 | Mastrangelo | 156/644 |
| 5,259,890 | 11/1993 | Goff | 134/32 |
| 5,288,333 | 2/1994 | Tanaka et al. | 134/31 |

(List continued on next page.)

FOREIGN PATENT DOCUMENTS 0 633 443 A1 1/1995 European Pat. Off. ..... F28D 20/00

OTHER PUBLICATIONS

Cryogenic Wafer Cleaning, *Micro Contamination Identification, Analysis and Control,* vol. 14(10), Nov./Dec. 1996 p. 50, 52.

J. H. Lee et al., "Fabrication of Surface Micromachined Polysilicon Actuators Using Dry Release Process of HF Gas–Phase Etching", International Electron Devices Meeting, San Francisco, CA, 1996, IEDM 96–761–764.

T. A. Lober et al., "Surface–Micromachining Processes for Electrostatic Microactuator Fabrication", Solid State Sensor and Actuator Workshop, Hilton Head Island, SC Jun. 6–9, 1988, pp. 59–62.

FSI Aries™ Cryokinetic Cleaning Systems Brochure (Sep. 1996).

*Primary Examiner*—Frankie L. Stinson
*Attorney, Agent, or Firm*—Vidas, Arrett & Steinkraus

[57] ABSTRACT

Stiction in a microstructure may be eliminated by directing a cryogenic aerosol at the portion of the microstructure subject to stiction with sufficient force so as to free the portion of the microstructure.

27 Claims, 2 Drawing Sheets

U.S. PATENT DOCUMENTS 5,294,261 3/1994 McDermott et al. ..... 134/7
5,315,793 5/1994 Peterson et al. ..... 51/415
5,354,384 10/1994 Sneed et al. ..... 134/6
5,364,474 11/1994 Williford, Jr. ..... 134/32
5,366,156 11/1994 Bauer et al. ..... 239/135
5,372,652 12/1994 Srikrishman et al. ..... 134/7
5,377,911 1/1995 Bauer et al. ..... 239/135
5,378,312 1/1995 Gifford et al. ..... 156/643
5,456,758 10/1995 Menon ..... 134/33
5,486,132 1/1996 Cavaliere et al. ..... 451/75
5,512,106 4/1996 Tamai et al. ..... 134/7
5,555,902 9/1996 Menon ..... 134/199
5,658,636 8/1997 Reed et al. .
5,694,740 12/1997 Martin et al. .
5,766,368 6/1998 Bowers ..... 134/6
5,772,902 6/1998 Reed et al. .

ELIMINATING STICTION WITH THE USE OF CRYOGENIC AEROSOL

BACKGROUND OF THE INVENTION

The use of microstructures as sensors, motors, gears, levers and movable joints in integrated circuits is becoming increasingly common. In the automotive industry, microstructure sensors capable of sensing mechanical variables such as acceleration are being used widely in the construction of anti-lock brake systems. The silicon diaphragm pressure gauge, a microstructure useful in monitoring fluid flow, is presently manufactured in large quantities. Microchemical sensors are expected to have wide spread application in demanding environments where small amounts of a chemical must be sensed and where conventional sensing devices are too large.

Along with the increasing demand for microstructures, there is also a demand for ever smaller microstructures. Although at present microstructures may be characterized by dimensions of upwards of 1000 $\mu$m (1000 microns) and as small as 1 $\mu$m or smaller, as industry moves toward ever smaller geometries, it is expected that the size of microstructures will continue to shrink.

With the development of microstructures and ever more intricate micromachines, new engineering problems arise that are unique to the microsizes involved. One such common and costly problem in the micromachining industry is stiction, which can occur during the release of free-standing microstructures by removing sacrificial layers used to support the free-standing microstructures when they are being constructed. Typically, sacrificial materials such as silicon dioxide are removed in a so called 'wet release method' by use of an aqueous hydrogen fluoride solution. Stiction occurs when liquid, such as aqueous hydrogen fluoride or rinse solutions, comes into contact with microstructures causing the microstructures to stick to one another or to the substrate. This can occur either during or after the release process. Moreover, this phenomena is not limited to semiconductor substrates but may occur on other substrates as well.

Solutions to the problem of stiction include the use of micromechanical temporary supports, sublimation of the final liquid by plasma ashing, removing the final liquid through the supercritical state, the use of low surface tension liquids and photon assisted release methods. An example of the use of micromechanical temporary supports may be found in U.S. Pat. No. 5,258,097 to Mastrangelo wherein temporary posts or columns are erected to support the microstructure. Unfortunately, techniques such as this add additional costs to the fabrication of chips; as the desired structures become increasingly intricate, the design of dry release methods will become more complex and expensive. Moreover, as with all of these release techniques, stiction can recur should a subsequent process step introduce moisture into the system once the structure has been released.

Currently, the process of unsticking stuck structures is time consuming and laborious. Stuck structures are freed by physically manipulating the structures with a probe. Because of the size of the structures, this process must be carried out under a microscope. Accordingly, there is a need in the art for a novel method of freeing stuck microstructures which avoids the necessity of unsticking the individual structures one-at-a-time in a painstaking process.

The present invention offers a method for eliminating stiction by cooling the microstructure and subjecting it to a force. One such method involves the use of cryogenic aerosols. Cryogenic aerosol technology has been developed as a cleaning means for substrates. U.S. Pat. No. 4,747,421 to Hayashi describes an apparatus for cleaning substrates using carbon dioxide aerosol particles. U.S. Pat. No. 5,294,261 to McDermott et al., the contents of which are incorporated herein by reference, discloses a method for cleaning microelectronic surfaces using an aerosol of at least substantially solid argon or nitrogen particles. Copending US application, titled "Treating Substrates by Producing and Controlling a Cryogenic Aerosol" of Patrin et al., filed contemporaneously with the present application, and assigned to the same assignee, the contents of which are incorporated herein by reference, discloses an improved method for forming a cryogenic aerosol at low chamber pressure. U.S. Pat. No. 5,378,312 to Gifford et al., the contents of which are incorporated herein by reference, discloses a method of fabricating a semiconductor structure which includes the use of a cryogenic jet stream for the removal of films from the surface of the semiconductor. The present invention, in one embodiment, applies the technology of cryogenic aerosols to the problem of stiction with surprisingly good results.

SUMMARY OF THE INVENTION

The present invention is directed to a method for reducing and eliminating stiction in microstructures. In one embodiment, stuck microstructures are released through a process using an impinging stream of a cryogenic aerosol. A liquid, gaseous or combination of liquid and gaseous stream is expanded, forming at least substantially solid gas particles in the stream. The resulting cryogenic aerosol is directed at the surface of the microstructure and applied to the entire substrate.

DETAILED DESCRIPTION OF THE INVENTION

One of the major issues in the production of microstructures is process induced stiction of highly compliant or otherwise moveable microstructures. Stiction is often caused by capillary forces that arise when liquids come into contact with the microstructures during the manufacturing process. These liquids when dried may also leave behind thin films with adhesive characteristics which hold the microstructures together.

Figure 1:
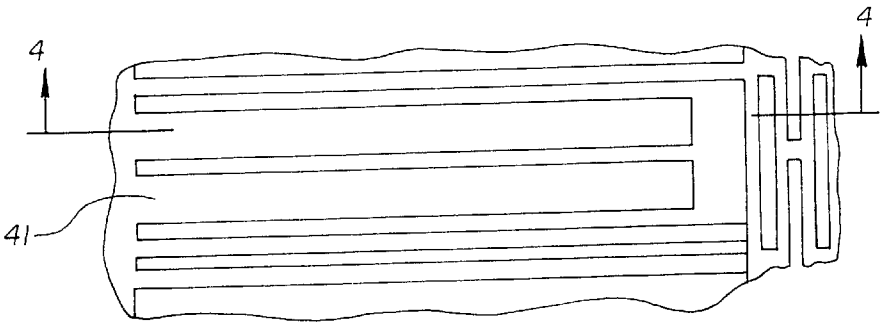
FIG. 1 depicts a top view of a wafer with microstructures that are free of stiction.
Figure 2:
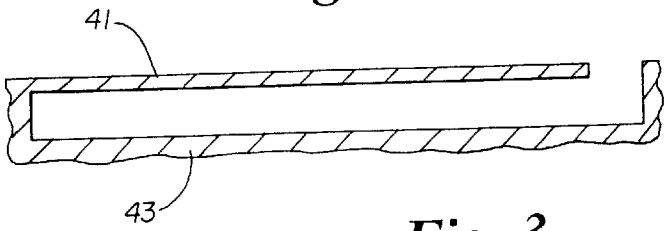
FIG. 2 is a side view of FIG. 1.
Figure 3:
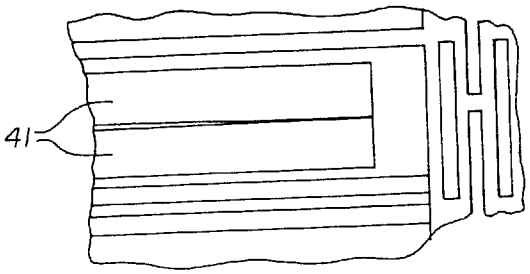
FIG. 3 depicts the wafer of FIG. 1, following treatment with deionized water, with microstructures exhibiting lateral stiction
Figure 4:
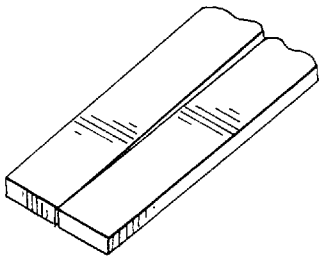
FIG. 4 depicts a partial perspective view of FIG. 3.
Figure 5:
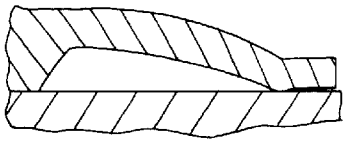
FIG. 5 depicts a side view of the wafer of FIG. 1, following treatment with deionized water, with microstructures exhibiting vertical stiction.

Examples of stiction include, but are not limited to adjacent microstructures sticking to one another, microstructures sticking to substrate surfaces and moveable microstructures such as wheels, rotors and gears freezing in place. FIGS. 1–5 illustrate the problem of stiction between two adjacent freestanding beams. FIG. 1 depicts a top view of part of a sensor containing many freestanding beams which are free of stiction. The two beams 41 shown in FIG. 1 are not subject to stiction. FIG. 2 is a side view of the beams showing the beams 41 as freestanding, not subject to vertical stiction-stiction to the underlying substrate 43. FIG. 3 depicts a top view of the two adjacent freestanding sensors following wet treatment of the device. The beams 41 are now subject to lateral stiction having joined together at the ends. FIG. 4 is a partial perspective view of the area subject to stiction. FIG. 5 depicts a side view of a sensor on a wafer with the sensor exhibiting vertical stiction.

The present invention describes a method for freeing stuck areas of a microstructure such as a sensor, motor, gear, lever, movable joint, mirror or any other type of microstructure subject to stiction in which the area subject to stiction is subjected to a force in order to free the structure. The method is applied subsequent to any stiction causing process steps and may be used to treat multiple substrates simultaneously.

In the preferred embodiment of the invention, a cryogenic aerosol is directed from a nozzle at an area of a microstructure subject to stiction in order to free the microstructure. The cryogenic aerosol is formed by delivering gas and/or liquid to the nozzle. Upon expelling the mixture from the nozzle, the cryogenic aerosol is formed. The cryogenic aerosol contains substantially solid particles and/or liquid particles in a gaseous stream. The term "particles" as used herein shall refer to droplets comprised of liquid and/or solid generally of about 0.01 to about 100 microns in diameter or larger. The particles may further be partially solid or partially liquid Typically, cryogenic aerosols are formed from chemicals such as argon, nitrogen, carbon dioxide and mixtures thereof. Other inert chemicals may be used as well. Without being bound by theory, the small liquid droplets may be formed from larger droplets of cryogen that are atomized by high pressure gas that expands from the orifices of a nozzle into a lower pressure process chamber. Particles so formed are generally of about one tenth to one-hundred microns although they may be as small one one-hundredth of a micron or they may be larger than one hundred microns in diameter.

Figure 6:
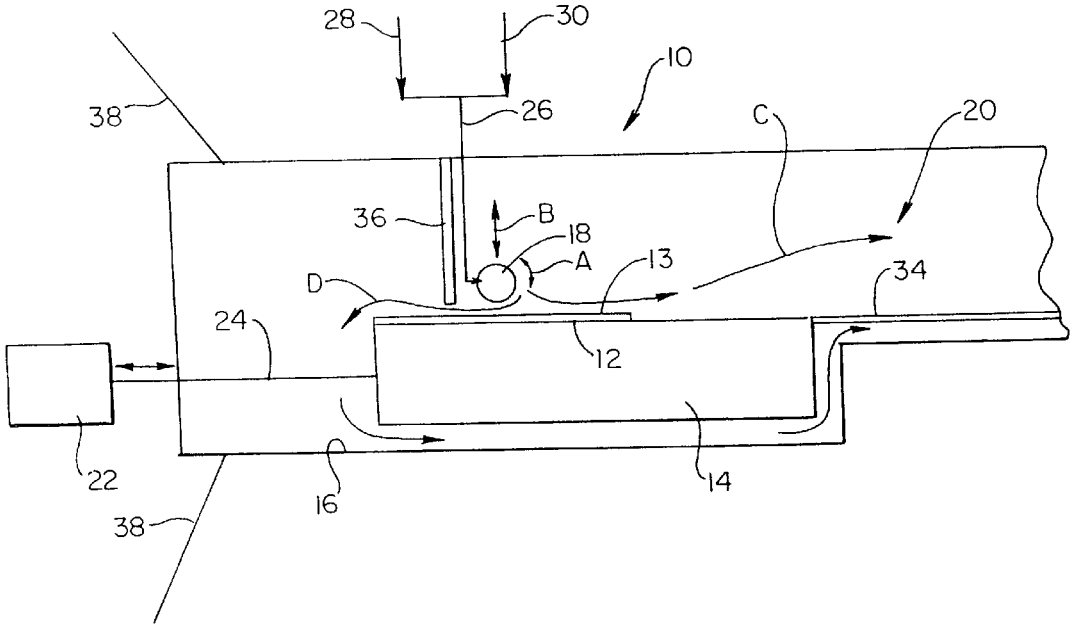
FIG. 6 depicts a schematic representation of the apparatus used in the present invention.

In the preferred embodiment an apparatus as depicted in FIG. 6 is used to treat the microstructure. Referring to FIG. 6, the microstructure 12 is mounted on a movable chuck 14, which is at ambient or heated temperature. The chuck 14 functionally supports the object to be treated. The chuck includes the appropriate slide or glide mechanism or turntable. A rotatably adjustable nozzle 18, from which the cryogenic aerosol emanates, is supported within the process chamber 16. Nozzle 18 is connected with a supply line 26, which itself may be connected further with discreet supply lines 28 and 30 connected with the actual gas or liquid supplies of argon, nitrogen or the like, depending on the specific process. Further processing steps, such as gas cooling, may take place within the supply line 26, again, depending on the specific process, so that the nozzle 18 expels the desired cryogenic aerosol. The inside of the process chamber 16 can, optionally, be connected further with either a vacuum device or a pressurizing device for selectively controlling the desired pressure within the process chamber 16 based on the specific process parameters. A vacuum device (not shown) can be connected through the exhaust duct 20.

To control the fluid dynamics within the process chamber 16, a flow separator comprising a baffle plate 34 is connected to an end of the moveable chuck 14 and extending into the exhaust duct 20. Additionally, a shroud 36 is provided within the process chamber 16 and comprises a plate connected to the process chamber 16, such as its upper wall, for controlling flow around the nozzle. The controlling of the fluid dynamics within the process chamber 16 by the baffle plate 34 and the shroud 36 are more fully described in copending U.S. application Ser. No. 08/712,342, filed Sept. 11, 1996 and incorporated herein by reference.

Also shown in FIG. 6, a curtain gas, preferably an inert gas such as nitrogen, can be introduced into the process chamber 16 via one or more supply conduits 38. Although not necessary, such curtain gas is preferably introduced at a location opposite the exhaust in the process chamber 16. The curtain gas may be used to compensate or make-up for slight pressure deviations within the process chamber caused by instabilities in the nozzle and pressure controls allowing for the overall positive flow across the chamber. Conventional supply techniques may be used.

In one embodiment, an argon/nitrogen mixture is filtered free of any contaminating particles and cooled to a temperature at or near its liquification point in a heat exchanger. Following the cooling operation, the argon/nitrogen mixture is a combination of gas and liquid.

In another embodiment, an argon/nitrogen mixture is filtered free of any contaminant particles and pre-cooled to a temperature slightly above its liquification point. Following the pre-cooling operation, the argon/nitrogen mixture is gas. The pre-cooling operation permits additional purification by allowing for partial condensation and removal of any remaining trace impurities onto the heat exchanger walls. Pre-cooling may be combined with simultaneous removal of trace impurities using a molecular sieve or catalytic impurities removal device or any other suitable impurities filter upstream of the heat exchanger. The argon/nitrogen mixture may then be fed into a second heat exchanger for the purpose of further cooling the mixture near to the point of liquification. Such methods for removing trace molecular impurities from inert gases are well known in the field. The pressure of the argon/nitrogen mixture is typically held in the range of $2.4\times10^5$ Pascal to $4.8\times10^6$ Pascal, preferably $2.4\times10^5$ Pascal to $7.8\times10^5$ Pascal. The temperature of the mixture is typically in the range of from about −200° C. (73.15 K) to about −120° C. (153.15 K) and preferably from about −200° C. (73.15 K) to about −150° C. (123.15 K). The nitrogen flow rate is between 0 and 600 standard liters per minute (slpm), preferably 100–200 slpm, and the argon flow rate is between 0 and 600 slpm, preferably 300–600 slpm.

The mixture, whether gas, liquid or a mixture of both, is then expanded from a nozzle 18 from a pressure of approximately $2.4\times10^5$ Pascal to $4.8\times10^6$ Pascal, preferably $2.4\times10^5$ Pascal to $7.8\times10^5$ Pascal, to a lower pressure, and a temperature at or near the liquification point of the argon/nitrogen mixture to form at least substantially solid particles of the mixture with gaseous argon and/or nitrogen. Preferably, the process chamber is maintained at a pressure $1.01\times10^5$ Pascal or less, more preferably at a pressure $1.6\times10^4$ Pascal or less and most preferably at a pressure $1.2\times10^4$ Pascal or less. The nozzle is rotatable and/or translatable toward or away from the microstructure to be treated as described in copending application Ser. No. 08/773,489 filed Dec. 23, 1996 and previously incorporated herein by reference.

The nozzle and the cryogenic aerosol emanating from the nozzle, are directed at the substrate at an angle between substantially parallel and perpendicular, suitably at an inclined angle between 5° and 90°, more preferably at an angle between 30° and 60° toward the surface of the substrate containing the microstructure. An angle of 0° denotes directing the cryogenic aerosol perpendicular to the substrate while an angle of 90° denotes directing the cryogenic aerosol parallel to the substrate. One skilled in the art will recognize that the cryogenic aerosol will likely diverge from the nozzle such that a steady single stream of particles will not necessarily be directed at a microstructure. Rather, the aerosol itself may diverge from the nozzle in a range from a 1° to 180° angle. The nozzle is typically at a vertical distance of approximately several millimeters to several centimeters above the microstructure.

Depending on the choice of nozzle and/or chamber design, multiple substrates may be treated simultaneously.

One device capable of forming such a cryogenic aerosol and so treating microstructures subject to stiction is an ARIES™ cryogenic aerosol tool, supplied by FSI International, Inc. Chaska, Minn., and configured with the above described process chamber and nozzle.

A number of parameters will affect the efficacy of the process. First, the choice of chemical or chemicals is preferably limited to chemicals which are unreactive with the substrate or any microstructures or microdevices on the substrate. Preferably, nitrogen, argon or mixtures thereof are used. A preferred embodiment of the present invention uses an at least substantially solid argon/nitrogen particle-containing aerosol to eliminate stiction in microstructures. Argon and nitrogen, inert chemicals, are preferred so as not to harm the substrates on which the microstructures are located or any microstructures on the substrate. Argon or nitrogen can be used alone or mixed in the present invention, preferably argon and nitrogen will be in the ratio in the range of 5:1 to 1:1 by volume. The present method is not, however, limited to the use of argon/nitrogen mixtures. Argon or nitrogen may be used exclusively. Other chemicals that may be used include carbon dioxide, krypton, xenon, neon, helium, chlorofluorohydrocarbons, inert hydrocarbons, and combinations thereof with each other or with argon and/or nitrogen.

The size of the particles comprising the cryogenic aerosol will desirably be controlled so as to avoid damaging the microstructure. Particles that are excessively large may cause pitting or other damage to the microstructure. Particles that are too small may prove ineffective in eliminating stiction. Of course, the lower limit of particle size will depend on the size of the microstructure. A suitable particle size range is from 0.01–100 $\mu$m.

Additionally, the direction of the cryogenic aerosol must be chosen to eliminate stiction and reduce damage to the microstructures. The specific orientation of the microstructure relative to the flow of the cryogenic aerosol will depend on the nature of the microstructure and nearby microstructures.

The microstructure may be held stationary and the nozzle directing the flow moved. However, in a preferred embodiment the microstructure is translated through the flow of the cryogenic aerosol at a uniform rate of 0.2 cm/sec to 15 cm/sec, preferably at a rate of 2 cm/sec to 10 cm/sec, and most preferably at 2 cm/sec to 5 cm/sec through the chamber, thereby ensuring that the entire stuck structure is subject to the impinging cryogenic aerosol. Suitably two or more passes under the cryogenic aerosol are made by the chuck. It should be noted that the chuck speed and the number of passes may be varied to suit the particular microstructure. Thus, the substrate may be subjected to additional passes under the cryogenic aerosol as necessary to eliminate the stiction. A rotatable chuck may also be used to orient the microstructure in the path of the cryogenic aerosol.

The velocity of the particles in the cryogenic aerosol should be sufficient to allow the aerosol to penetrate any gas boundary layer that might exist on the substrate. Yet, the velocity must not be so high as to initiate etching of the substrate or damage the microstructure. A suitable particle velocity is in the range of 10–100 meters per second.

The invention is illustrated by the following non-limiting example.

EXAMPLE

A sensor comprising microstructures free of stiction was treated with deionized water to induce stiction. The sensor prior to water treatment, when viewed from the top looked similar to the sensor shown in FIG. 1. The two adjacent polysilicon beams 41 of 11 $\mu$m thick and 225 and 250 $\mu$m in length are not touching each other. FIG. 2 is a side view of the beams 41 showing the beams to be freestanding, not subject to stiction to the underlying substrate 43. Following treatment with water, the beams, subject to lateral stiction, resembled those depicted in FIGS. 3 and 4. The substrate was subjected to two passes under a cryogenic aerosol consisting of argon and nitrogen in the ARIES™ tool with operating parameters as follows: argon flow: 340 standard liters per minute (slpm), nitrogen: 170 slpm, carrier nitrogen: 100 slpm, chuck speed: 2.25 cm/sec, chuck temperature: 20° C., chamber pressure: $1.6\times10^4$ Pascal. Following treatment with the cryogenic aerosol, the beams again resemble those shown in FIG. 1.

Those skilled in the art will recognize that the process of the invention will also be useful in applications other than those specifically identified herein and such other applications should be considered to be within the scope of the patent granted hereon.

What is claimed is as follows:

1. A method for freeing a stuck microdevice on a substrate comprising applying a cryogenic aerosol to said stuck microdevice so as to free the stuck microdevice wherein:

said cryogenic aerosol is comprised of at least one chemical that is chemically unreactive with the microdevice and substrate, the chemical being a liquid or gas at ambient temperature and pressure; and said cryogenic aerosol is comprised of at least substantially solid particles of said at least one unreactive chemical in a liquid or gaseous stream of said at least one unreactive chemical.

2. The method of claim 1 wherein said at least one chemical is selected from the group consisting of helium, nitrogen, neon, argon, krypton, carbon dioxide, chlorofluorocarbons, inert hydrocarbons and mixtures thereof.

3. The method of claim 2 wherein the cryogenic aerosol is formed by cooling the at least one chemical and rapidly expanding the cooled at least one chemical so as to form solid particles of said chemical.

4. The method of claim 3 wherein the cryogenic aerosol is formed from a mixture of nitrogen flowing at a rate between 20 and 600 standard liters per minute and argon gas flowing at a rate between 20 and 600 standard liters per minute.

5. The method of claim 3 wherein said at least one chemical consists respectively of from about 0 to about 100 percent argon by volume and from to about 100 to about 0 percent nitrogen by volume.

6. The method of claim 3 wherein said at least one chemical is cooled to a temperature in the range from about −200° C. to about −120° C. before forming said cryogenic aerosol.

7. The method of claim 6 wherein said cooling is performed to a temperature in the range of from about −150° C. to about −200° C.

8. The method of claim 3 wherein said at least one chemical is at a pressure in the range from about $2.4\times10^5$ Pascals to about $4.8\times10^6$ Pascals.

9. The method of claim 3 wherein the gaseous at least one chemical is expanded into a chamber, the pressure of said chamber being less than about $1.01\times10^5$ Pascals.

10. The method of claim 3 wherein the at least one chemical is expanded into a chamber, the pressure of said chamber being less than about $1.6\times10^4$ Pascals.

11. The method of claim 3 wherein the at least one chemical is expanded into a chamber, the pressure of said chamber being less than about $1.2\times10^4$ Pascals.

12. The method of claim 3 further comprising orienting said microdevice relative to said aerosol to reduce damage to said microdevice and/or enhance freeing of said stuck microdevice.

13. The method of claim 2 wherein said at least one chemical is supplied in substantially gas and/or liquid phase before forming said cryogenic aerosol.

14. The method of claim 1 wherein the cryogenic aerosol consists of at least substantially solid particles comprised of a mixture of argon and nitrogen in an argon and/or nitrogen carrier gas.

15. The method of claim 1 wherein the substrate is mounted on a stationary or displaceable chuck and oriented such that the portion of the microdevice subject to stiction is exposed to the cryogenic aerosol.

16. The method of claim 1 wherein the cryogenic aerosol is applied to the surface of said microdevice at an acute angle formed by said surface of said microdevice and the direction of the aerosol.

17. The method of claim 16 wherein said acute angle is from about 0° to about 90°.

18. The method of claim 1 wherein said microdevice is selected from the group consisting of sensors, motors, gears, levers, mirrors and movable joints.

19. The method of claim 1 wherein said substrate is mounted on a translatable chuck.

20. The method of claim 19 wherein said substrate attached to said chuck is moved through said cryogenic aerosol one or more times until the stuck microdevice is freed.

21. The method of claim 20 wherein said chuck is translated at a uniform rate of 0.2 to 15.0 cm/sec.

22. The method of claim 1 wherein the substrate is in a process chamber, and further comprising the steps of:

applying an inert gas stream to the microdevice; and venting the process chamber so as to remove contaminants from the process chamber.

23. The method of claim 22 wherein said inert gas is nitrogen.

24. A method for reducing stiction in a microdevice on a substrate comprising: applying a cryogenic aerosol to at least a portion of said microdevice wherein said cryogenic aerosol is comprised of at least one chemical that is chemically unreactive with the microdevice and substrate, the chemical being a liquid or gas at ambient temperature and pressure: and said cryogenic aerosol is comprised of at least substantially solid particles of said at least one unreactive chemical in a liquid or gaseous stream of said at least one unreactive chemical.

25. The method of claim 24 wherein the cryogenic aerosol is applied to the entire microdevice.

26. The method of claim 24 wherein only a portion of the microdevice is subject to stiction and the cryogenic aerosol is applied to the portion of the microdevice subject to stiction.

27. The method of claim 24 wherein the stiction is eliminated.

* * * * *